US005556036A

United States Patent [19]

Chase

[11] Patent Number: 5,556,036

[45] Date of Patent: Sep. 17, 1996

[54] ADJUSTABLE ARC SPINKLER NOZZLE

[75] Inventor: Thomas G. Chase, San Marcos, Calif.

[73] Assignee: Hunter Industries Incorporated, San Marcos, Calif.

[21] Appl. No.: 329,256

[22] Filed: Oct. 26, 1994

[51] Int. Cl.[6] ..... B05B 1/32; B05B 1/26

[52] U.S. Cl. ..... 239/457; 239/460; 239/498; 239/513; 239/539; 239/DIG. 1

[58] Field of Search ..... 239/200, 201, 239/451, 457, 460, 498, 505, 513, 514, 518, 521, 522, 539, 541, 581.2, DIG. 1

[56] References Cited

U.S. PATENT DOCUMENTS

| | | | |
|---|---|---|---|
| 2,130,810 | 9/1938 | Munz | 239/391 |
| 2,785,013 | 3/1957 | Stearns | 239/498 X |
| 4,189,099 | 2/1980 | Bruniga | 239/DIG. 1 X |
| 4,579,285 | 4/1986 | Hunter | 239/457 |
| 5,083,709 | 1/1992 | Iwanowski | 239/DIG. 1 X |
| 5,148,990 | 9/1992 | Kah, Jr. | 239/539 X |
| 5,205,491 | 4/1993 | Hadar | 239/DIG. 1 X |
| 5,360,167 | 11/1994 | Grundy et al. | 239/460 |

*Primary Examiner*—Lesley D. Morris
*Attorney, Agent, or Firm*—Baker, Maxham, Jester & Meador

[57] ABSTRACT

An adjustable arc sprinkler nozzle comprises a first body member having a through passage including an inlet end for attachment to a source of pressurized water and an outlet end having a first spiral edge having axially offset ends, a second body member mounted coaxially of and rotatable relative to the first body member and a second spiral edge positioned for selectively overlapping the first spiral edge for defining a selectively adjustable arcuate outlet orifice, the outlet orifice having a predetermined height and an adjustable width, and diameter first and second spiral edges teeth forming one of the first and second spiral edges for maximizing the predetermined height relative to the width.

18 Claims, 3 Drawing Sheets

ADJUSTABLE ARC SPINKLER NOZZLE

BACKGROUND OF THE INVENTION

The present invention relates generally to irrigation or sprinkler nozzles, and pertains particularly to an improved sprinkler nozzle having an adjustable arcuate width.

The present invention is an improvement in adjustable orifice sprinkler nozzles of the type disclosed in U.S. Pat. No. 4,579,285 entitled ADJUSTABLE SPRINKLER SYSTEM and assigned to the assignee hereof. In that patent, an adjustable nozzle is disclosed wherein concentrically disposed relatively rotatable helical peripheral edges form a nozzle defined by an arcuate slit that is adjustable from 0 up to 360 degrees. The water flow for a given segment is determined by the vertical spacing between the peripheral edges. One problem with this nozzle construction is that the vertical spacing is normally very close for normal flow rates resulting in a tendency to clog with very small sand particles and debris.

We have developed modifications which overcome this problem by enlarging the opening for a given flow rate and arcuate segment. Other improvements also enhance the operation of the nozzle.

SUMMARY AND OBJECTS OF THE INVENTION

It is the primary object of the present invention to provide an improved adjustable arc nozzle that overcomes the above problems of the prior art.

An adjustable arc sprinkler nozzle, comprises a first body member having a through passage including an inlet end having means for attachment to a source of pressurized water and an outlet end having a first spiral edge having axially offset ends, a second body member mounted coaxially of and rotatable relative to said first body member and having means defining a second spiral edge positioned for selectively overlapping said first spiral edge for defining a selectively adjustable arcuate outlet orifice, said outlet orifice having a predetermined height and an adjustable width, and means for maximizing said predetermined height relative to said width by minimizing said outlet diameter relative to said inlet diameter.

BRIEF DESCRIPTION OF THE PREFERRED EMBODIMENTS

The above and other objects and advantages of the present invention will become apparent from the following description when read in conjunction with the accompanying drawings wherein.

DETAILED DESCRIPTION OF THE PREFERRED EMBODIMENTS

Figure 1:
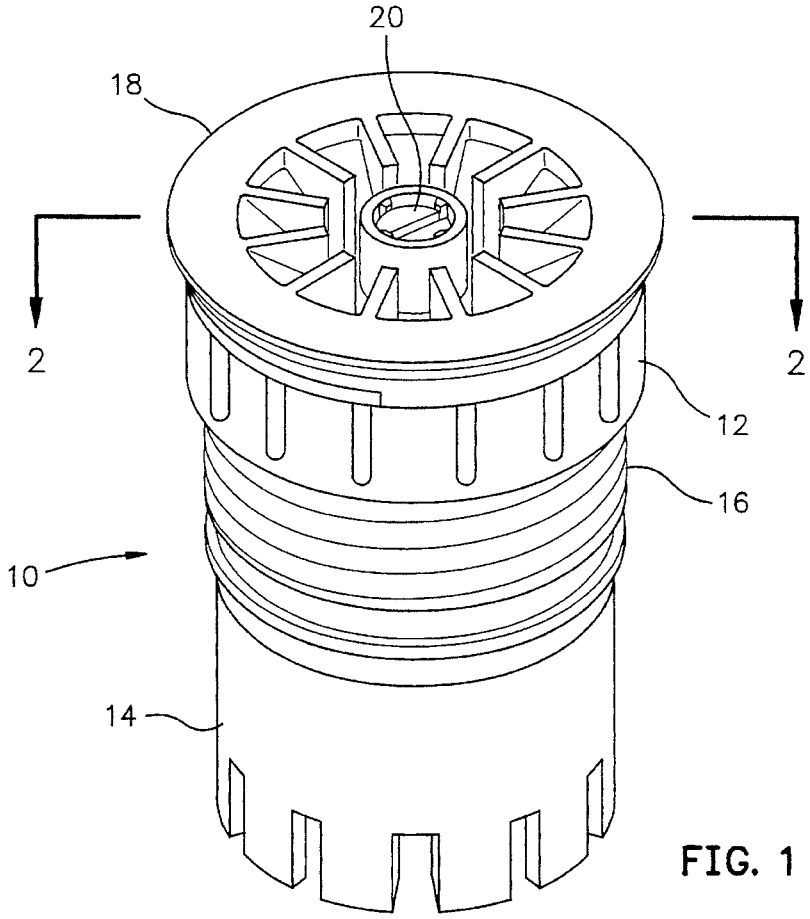
FIG. 1 is a perspective view of an exemplary preferred embodiment of the invention.

Referring to FIG. 1 of the drawings there is illustrated an exemplary embodiment of a sprinkler unit embodying the adjustable arc nozzle of the present invention and designated generally by the numeral 10. The sprinkler unit generally comprises a main body member 12 having a generally cylindrical tubular configuration with an inlet at a lower end 14 with suitable means such as threads 16 for attachment to a suitable source of pressurized water such as a riser. A second body arc cap member 18 is mounted coaxially of the main body member 12 at the upper or outlet end thereof and mounted for rotation relative thereto. The cap member 18 is threadably mounted for example on a threaded screw or stud 20 similarly threadably mounted to the main body member 12.

Figure 2:
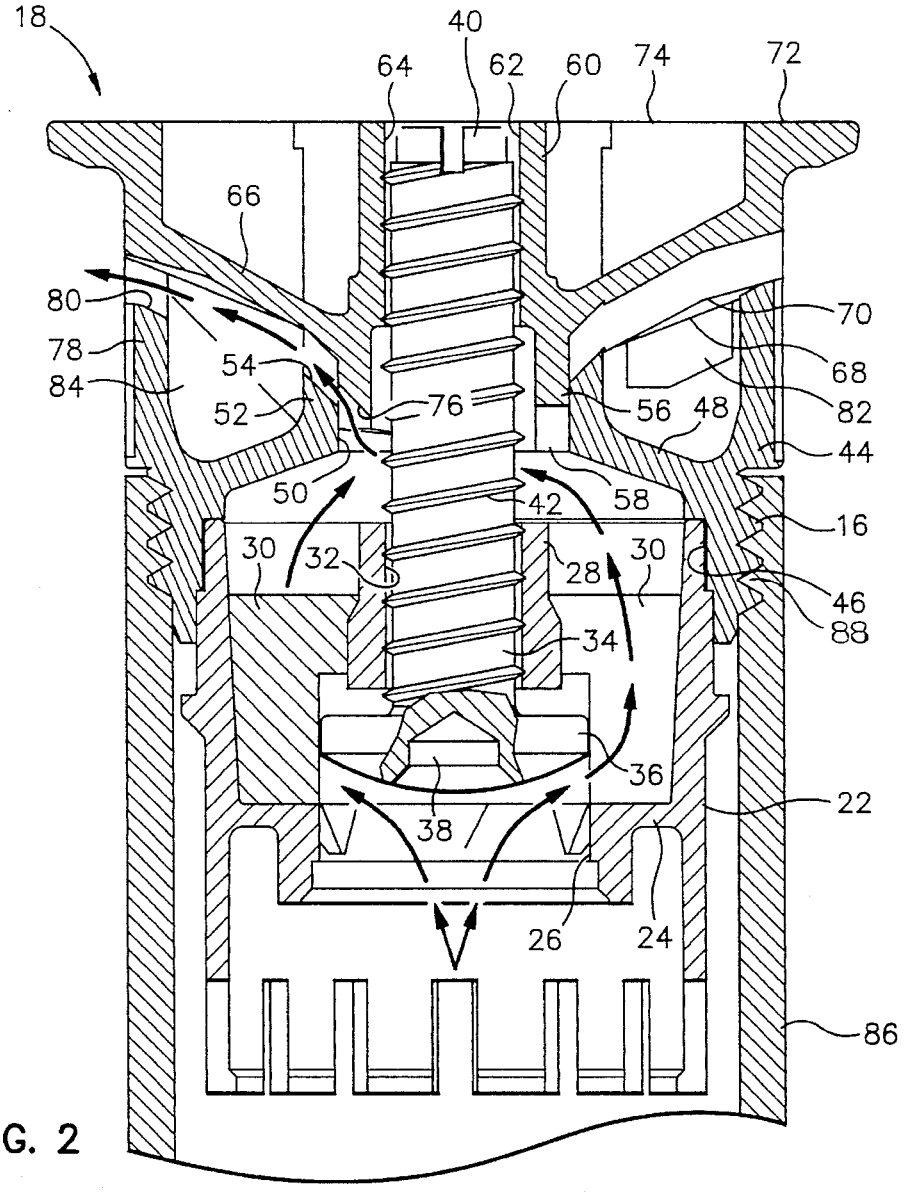
FIG. 2 is a section view taken generally along line 2—2 of FIG. 1.

Referring to FIG. 2, the main body member of the assembly is in the illustrated embodiment made up of a two-part assembly. A generally tubular housing member 22 has a generally cylindrical tubular configuration with an intermediate support wall 24 forming a central circular passage 26 opening from the lower end of the housing member to an upper or outlet end. A spider or spoked support structure comprises a central hub 28 with a plurality of ribs or spokes 30 extending radially outward therefrom to the walls of the housing member. The hub 28 has a central through bore 32 for receiving a threaded screw or stud 34 having a head 36 with a screwdriver or tool receiving slot or recess 38 in the head 36 and a screwdriver receiving cross-slot or other suitable tool connecting means 40 at the upper end. The stud 34 has threads 42 of a predetermined pitch extending the length thereof and threadably engaging the bore 32 of the central hub 28.

An upper end housing portion 44 is secured or fitted to the outlet or upper end of the housing member 22 and is suitably secured by threads, welding, or other suitable bonding or securing means at bore 46 to the upper end of the housing member 22. The upper end housing portion 44 has or is formed with walls 48 converging inward to a bore 50 having a diameter of less than that of the inlet diameter of the housing to reduce the radius of the outlet nozzle to thereby increase the height of the nozzle opening for a given flow rate as will be explained. The area of a slot opening is equal to the height times $\pi$ times the diameter ($h \times \pi d$). The outlet diameter of bore 50 may be on the order of about one-half that of the inlet bore as in the illustrated embodiment to thereby require twice the height of the nozzle opening for a given arc and flow rate. The end wall further provides an axially extending circumferential wall 52 having an axially extending helical or spiral end configuration and surface 54.

Figure 3:
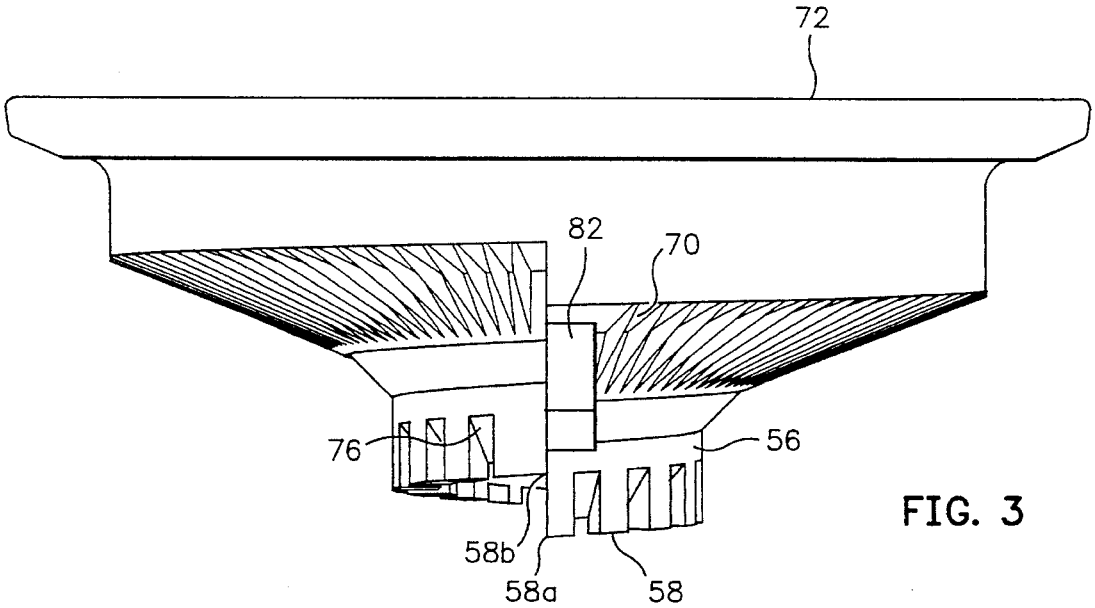
FIG. 3 is a front elevational view of the cap of FIG. 1.

Referring to FIGS. 2 and 3, the cap member 18 has a somewhat circular configuration being in the form of a generally stepped tubular member with a central hub-like structure having lower peripheral wall 56 for extending generally into bore 50 of the housing. The peripheral wall 56 extends axially and terminates at a lower most peripheral end in a helical or spiral end surface 58 having the same pitch as surface 54. The peripheral end surface 58 has axially off-set ends **58*a* and 58*b* at the end of the spiral. The tubular portion extends axially with an upper tubular portion 60 having an inner bore 62 with ribs 64 disposed around the periphery thereof into which threads 42 of the stud 34** threadably engage.

Figure 4:
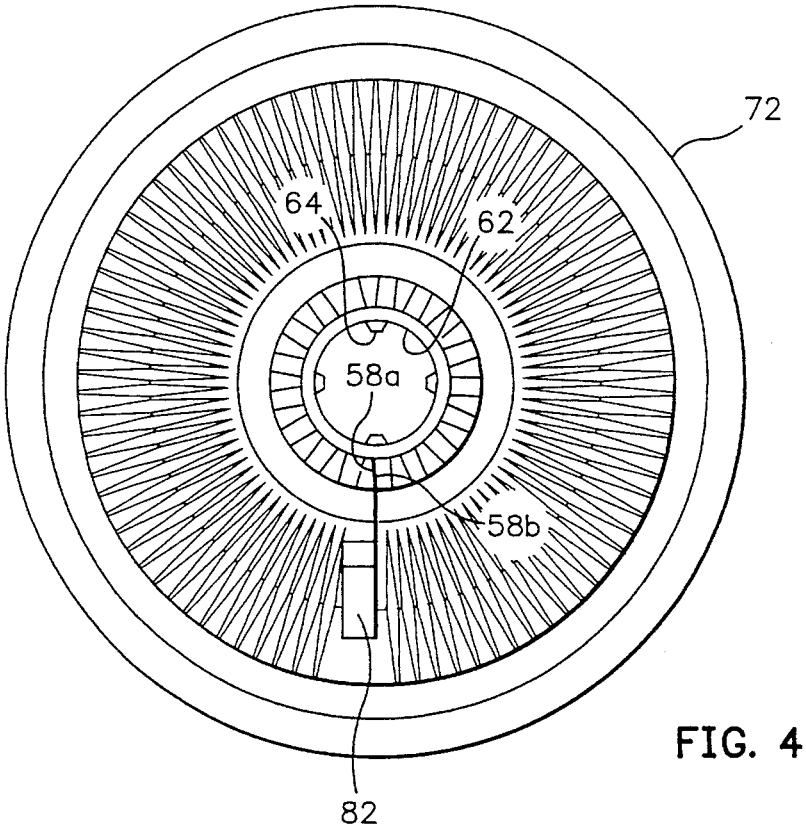
FIG. 4 is a bottom view of the cap of the embodiment of FIG. 1.
Figure 5:
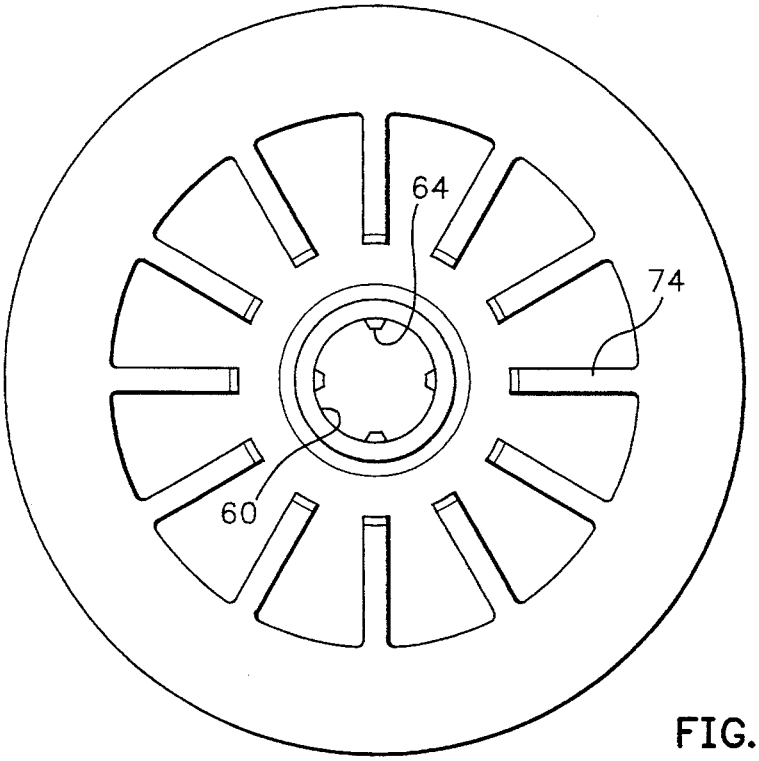
FIG. 5 is a top view of the cap of the embodiment of FIG. 1.

Radially outwardly extending wall 66 is formed with a lower spiral or helical surface 68 which has the same pitch as surfaces 54 and 48 and acts as a deflector surface. The surface 68 is formed with a plurality of radially outwardly extending shallow grooves 70. These radial grooves preferably slope from a minor depth at the innermost diameter outwardly to a maximum depth about one-half way to the outer diameter. The groove slopes again from the maximum depth to a minor or minimum depth at the outermost diameter. These grooves, as best seen in FIG. 4, function to better direct and distribute the stream of water in a more uniform pattern.

This helical or spiral lower surface 68 corresponds in pitch to that of the peripheral end portion 58 of the wall 56 and also the pitch of the terminal end portion 54 of the wall 52. Similarly, these correspond to the pitch of the threads of a screw or stud 34. The cap 18 includes an upper peripheral rim 72 and a plurality of ribs 74 forming slots between the ribs for receipt of a tool for rotation of the cap relative to the screw or stud 34.

The overlapping of walls 52 and 56 form a seal and close the outlet orifice or nozzle The spacing formed between the peripheral ends of the walls 54 and 58 upon rotation of the cap form a nozzle opening from which water flows. In the preferred embodiment, the wall 56 is formed with teeth or notches having a sloped base 76 which cooperates to form openings along the surface 54 of wall 52 to provide an orifice opening.

The upper end housing portion 44 as best seen in FIG. 2, is also formed with an outer generally cylindrical upstanding wall 78 having an upper spiral peripheral edge 80 corresponding to the slope of the surface 68 of cap 18. A slot opening is formed between edge 80 and surface 68 corresponding to an opening formed by edges 54 and 76. A stop member 82 on cap 18 (FIG. 4) engages a stop 84 on member 44 to limit rotation of cap 18 to about 360°. The nozzle unit may be mounted on a riser 86 by threaded engagement between threads 16 of the nozzle body and 88 of the riser.

In operation clockwise rotation of cap 18 moves it downward to a position of total overlap of walls 56 and 52 such that the nozzle outlet is completely closed. Rotation in the opposite direction opens a space between the surfaces 54 and 76 in the cooperative walls to provide a nozzle outlet opening having an arcuate configuration. The nozzle opening may extend from 0 to 360 degrees. The height of the opening is normally a predetermined fixed height for a given flow rate. However, this may be varied by proper independent rotation of a screw or stud 34 to move the cap 18 outward independent of relative rotation thereof with respect to the main housing.

The combination of the reduced or minimal diameter of the outlet relates to the inlet and the notched or toothed surface 58 of wall 56 provides a greater height in the nozzle slot opening relative to the width for a given fluid flow. This increased height reduces the prospect of clogging by means of small grains of sand and like debris.

Figure 6:
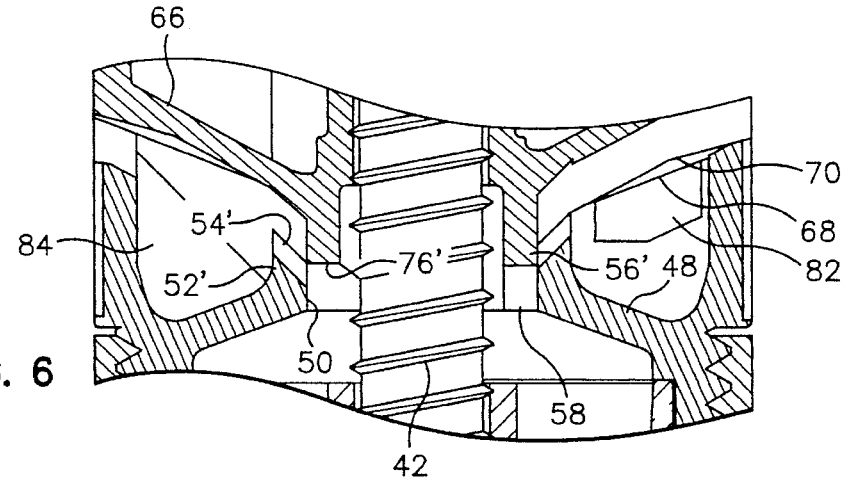
FIG. 6 is a detailed view in section of an alternate embodiment of the orifice of FIG. 2.

Referring to FIG. 6, an alternate embodiment of the orifice is illustrated wherein identical structure is identified by like numbers and alternate structure identified by the number primed. In this construction slots are formed in the upper edge 54' of lower peripheral wall 52' rather than in upper edge 76' as in the prior embodiment. The lower peripheral edge 76' of wall 56' or the cap is spiraled without notches.

While we have illustrated and described our invention by means of a specific embodiment, it is to be understood that numerous changes and modifications may be made therein without departing from the spirit and scope of the invention as defined in the appending claims.

I claim:

1. An adjustable arc sprinkler nozzle, comprising:

a first body member having a through passage including an inlet end of a first diameter having means for attachment to a source of pressurized water and an outlet end having a first spiral edge having axially offset ends; and a second body member mounted coaxially of and rotatable relative to said first body member and having means defining a second spiral edge positioned for selectively overlapping said first spiral edge for defining a selectively adjustable arcuate outlet orifice, said outlet orifice having a predetermined height and an adjustable width; and means including said first spiral edge and said second spiral edge having a minimum diameter relative to said first diameter for maximizing said predetermined height relative to said width, wherein said minimum diameter of said means including said first and second spiral edges is about one-half said first diameter.

2. An adjustable arc sprinkler nozzle according to claim 1, wherein said second body member includes a deflector head having a generally annular deflection surface having a generally spiral shape.

3. An adjustable arc sprinkler nozzle according to claim 2, wherein said deflection surface includes a plurality of radially extending shallow grooves.

4. An adjustable arc sprinkler nozzle according to claim 2, wherein said first and second body members are mounted relative to one another by means of a threaded stud having a spiral pitch equal to that of said first and second spiral edges.

5. An adjustable arc sprinkler nozzle according to claim 2, wherein said means for maximizing said predetermined height relative to said width comprises teeth forming one of said first and second spiral edges.

6. An adjustable arc sprinkler nozzle, comprising:

a first body member having a through passage including an inlet end having means for attachment to a source of pressurized water and an outlet end having a first spiral edge having axially offset ends; and a second body member mounted coaxially of and rotatable relative to said first body member and having means defining a second spiral edge positioned for selectively overlapping said first spiral edge for defining a selectively adjustable arcuate outlet orifice, said outlet orifice having a predetermined height and an adjustable width; and means for maximizing said predetermined height relative to said width, wherein said means for maximizing said predetermined height relative to said width comprises teeth forming one of said first and second spiral edges.

7. An adjustable arc sprinkler nozzle according to claim 6, wherein said means for maximizing said predetermined height relative to said width comprises minimum diameter first and second spiral edges.

8. An adjustable arc sprinkler nozzle, comprising:

a body member having a through passage including an inlet end having means for attachment to a source of pressurized water and an outlet end having means defining a first spiral edge having axially offset ends; and a cap member rotatably mounted coaxially of and at said outlet end of said body member and having means defining a second spiral edge positioned for selectively overlapping said first spiral edge for defining a selectively adjustable arcuate outlet arc, said outlet arc having a predetermined height and an adjustable width; and a plurality of notches in one of said first and said second spiral edge for maximizing said predetermined height relative to said width.

9. An adjustable arc sprinkler nozzle according to claim 8, wherein said first and second spiral edges are constructed of minimum diameter for maximizing said predetermined height relative to said width.

10. An adjustable arc sprinkler nozzle according to claim 8, wherein said notches are generally rectangular in configuration.

11. An adjustable arc sprinkler nozzle according to claim 10 wherein said cap member includes a deflector head having a generally annular deflection surface having a generally spiral shape.

12. An adjustable arc sprinkler nozzle according to claim 11, wherein said deflection surface includes a plurality of radially extending shallow grooves.

13. An adjustable arc sprinkler nozzle according to claim 12, wherein said cap member and said body members are mounted relative to one another by means of a threaded stud having a spiral pitch equal to that of said first and second spiral edges.

14. An adjustable arc sprinkler nozzle, comprising:

a generally cylindrical body member having a through passage including an inlet end having means for attachment to a source of pressurized water and an outlet end having means defining a first spiral edge having axially offset ends extending around an outlet opening of said body member;

a cap member rotatably mounted coaxially of and at said outlet end of said body member and having means defining a second spiral edge positioned for selectively overlapping said first spiral edge for cooperatively defining a selectively adjustable arcuate outlet opening, said outlet opening having a predetermined height and a selectively adjustable width; and a plurality of generally rectangular notches in one of said first and said second spiral edge for maximizing said predetermined height relative to said width.

15. An adjustable arc sprinkler nozzle according to claim 14, wherein said first and second spiral edges are constructed of minimum diameter for maximizing said predetermined height relative to said width.

16. An adjustable arc sprinkler nozzle according to claim 15 wherein said cap member includes a deflector head having a generally annular deflection surface having a generally spiral shape, and a plurality of radially extending shallow grooves.

17. An adjustable arc sprinkler nozzle according to claim 16, wherein said cap member and said body members are mounted relative to one another by means of a threaded stud having a spiral pitch equal to that of said first and second spiral edges.

18. An adjustable arc sprinkler nozzle according to claim 17, wherein said body member has a central hub having a coaxial bore and said threaded stud is mounted in said bore.

* * * * *